US007186121B1

(12) United States Patent
Costello et al.

(10) Patent No.: US 7,186,121 B1
(45) Date of Patent: Mar. 6, 2007

(54) GUIDE AND POWER DELIVERY MODULE

(75) Inventors: Brian Patrick Costello, Scotts Valley, CA (US); Danny Kwun-Man Chau, Fremont, CA (US); Donald E. Wood, Fremont, CA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/250,291

(22) Filed: Oct. 14, 2005

(51) Int. Cl.
*H01R 12/00* (2006.01)

(52) U.S. Cl. ..... 439/79

(58) Field of Classification Search ..... 439/65, 439/101, 108, 541.5, 843
See application file for complete search history.

(56) References Cited

U.S. PATENT DOCUMENTS 4,628,410 A * 12/1986 Goodman et al. ..... 361/789
4,820,169 A * 4/1989 Weber et al. ..... 439/65
5,197,893 A * 3/1993 Morlion et al. ..... 439/101
6,234,834 B1 * 5/2001 Tsai et al. ..... 439/541.5
6,322,377 B2 * 11/2001 Middlehurst et al. ..... 439/79
6,394,818 B1 * 5/2002 Smalley, Jr. ..... 439/79
6,632,107 B1 * 10/2003 Vanbesien ..... 439/680

* cited by examiner

*Primary Examiner*—Tulsidas C. Patel
*Assistant Examiner*—Harshad C Patel

(57) ABSTRACT

A guide module for connecting a first circuit board and a second circuit board and delivering power between the first and second circuit boards is provided. The guide module includes a guide module housing configured to be mechanically mounted to the first circuit board. A power contact is held in the guide module housing. The power contact is configured to convey current between the first and second circuit boards.

10 Claims, 7 Drawing Sheets

GUIDE AND POWER DELIVERY MODULE

BACKGROUND OF THE INVENTION

The invention relates generally to circuit board interconnecting systems and, more particularly, to a guide module with power delivery.

At least some electronic systems, such as some networks and computer systems, include a primary circuit board, such as a backplane board, connected to one or more peripheral boards called daughter cards. Electrical connectors establish electrical communication between the backplane and the daughter cards. Along with the electrical connectors, a guidance system is sometimes provided that allows at least gross alignment of the daughter card to the backplane. While some large guide pin systems may include electrostatic contacts such that an electrical connection is made to discharge static electricity, the guidance system generally provides only mechanical guidance.

In order to save space on the backplane and daughter card circuit boards, some connectors perform dual functions. For instance, some signal connectors also include contacts for power transmission. However, the power carrying capacity of such connectors is generally less than the power carrying capability of a typical power connector. In the typical power connector, the contacts are allowed to float in a housing such that the contacts in the power connectors move and find each other when the connectors are mated. This renders the typical power connector unsuitable for providing guidance.

It would be desirable to provide a guidance system that could also transmit power between the backplane and daughter cards so that space could be saved on the backplane and the daughter cards.

BRIEF DESCRIPTION OF THE INVENTION

In one embodiment, a guide module for connecting a first circuit board and a second circuit board and delivering power between the first and second circuit boards is provided. The guide module includes a guide module housing configured to be mechanically mounted to the first circuit board. A power contact is held in the guide module housing. The power contact is configured to convey current between the first and second circuit boards.

Optionally, the guide module further includes a pair of the power contacts that have contact tails positioned in a linearly spaced orientation along a length of the guide module housing. The power contact includes a guide receptacle configured to receive a guide pin carrying an electrical current. The guide module further includes a pair of power contacts that include guide receptacles that are linearly spaced vertically along a height of the guide module housing. The power contact includes a guide receptacle that has a wedge formed thereon. The wedge engages an interior surface of the guide module housing to inhibit extraction of the power contact from the guide module housing.

In another embodiment, a guide and power delivery assembly for connecting and delivering power between first and second circuit boards. The assembly includes a guide module housing configured to be mechanically mounted to the first circuit board. A power contact is held in the guide module housing. The power contact is configured to convey electrical current between the circuit boards. A current carrying guide pin is configured to be mounted on the second circuit board. The guide pin is matable to the power contact.

DETAILED DESCRIPTION OF THE INVENTION

Figure 1:
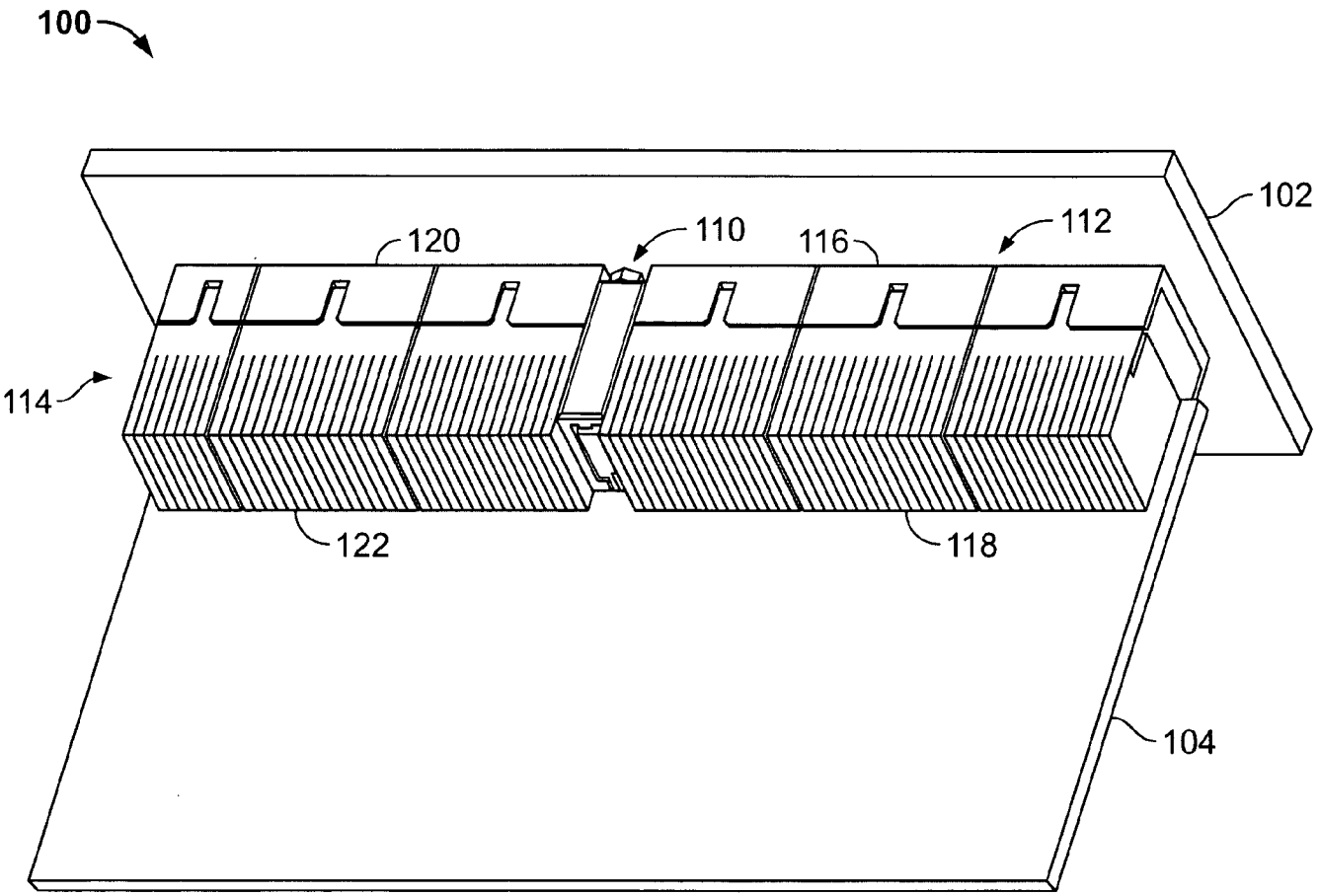
FIG. 1 is a perspective view of a circuit board assembly including a guide module formed in accordance with an exemplary embodiment of the present invention.

FIG. 1 is a perspective view of a circuit board assembly 100. The circuit board assembly includes a first circuit board 102 that is connected to a second circuit board 104. The assembly also includes a guide and power delivery assembly 110 formed in accordance with an exemplary embodiment of the present invention. In an exemplary embodiment, the first circuit board 102 may be a backplane board and the second circuit board 104 may be a daughter card. By way of example only, the circuit board assembly 100 includes signal connectors 112 and 114. In an exemplary embodiment, the guide and power delivery assembly 110 is positioned between the connectors 112 and 114. It is to be understood, however that the guide and power delivery assembly 110 may be located at any location along the interface between the first and second circuit boards 102 and 104 respectively; and further, the guide and power delivery assembly 110 may be present in any number. The signal connector 112 includes a plug connector 116 mounted on the first circuit board 102 and mated to a receptacle connector 118 mounted on the second circuit board 104. The signal connector 114 includes a plug connector 120 mounted on the first circuit board 102 and mated to a receptacle connector 122 mounted on the second circuit board 104.

Figure 2:
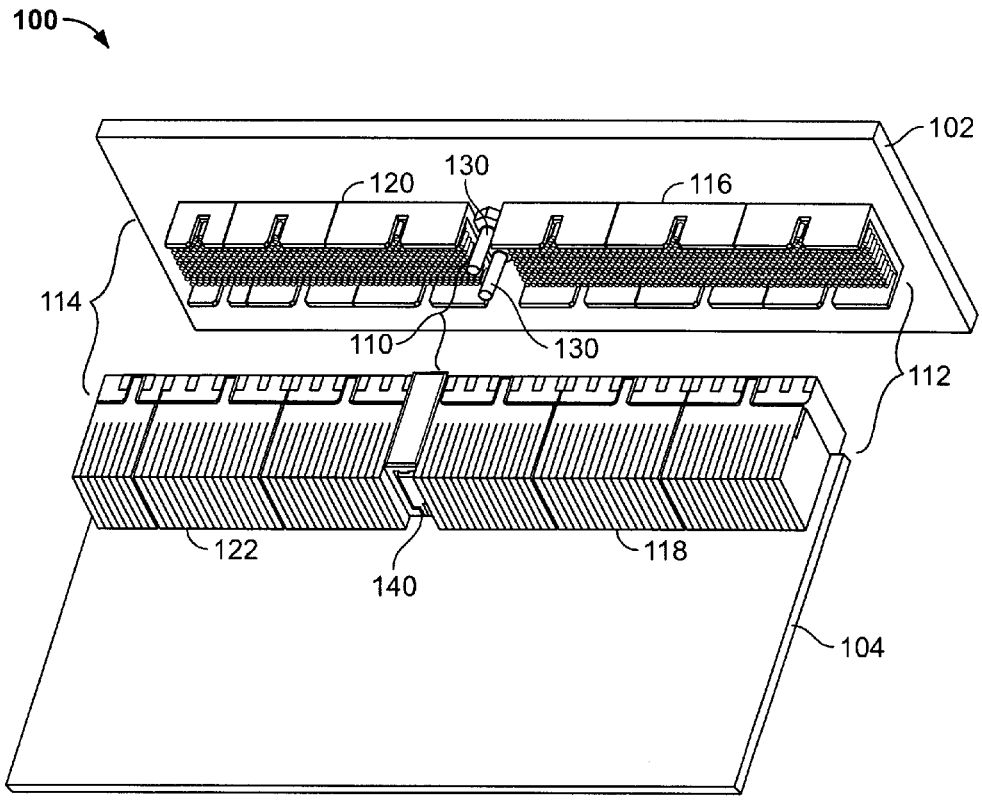
FIG. 2 is a perspective view of the assembly shown in FIG. 1 with the daughter board separated from the backplane board.

FIG. 2 is a perspective view of the assembly 100 with the first and second circuit boards 102 and 104, respectively, separated from one another. The guide and power delivery assembly 110 includes guide pins 130 mounted on the first circuit board 102 and a guide module 140 that is mounted on the second circuit board 104. While the typical guidance system provides gross alignment of two circuit boards, the guide and power delivery assembly 110 provides more precise alignment of the first and second circuit boards 102 and 104 so that when the first and second circuit boards 102 and 104 come together, the mating contacts in the signal connectors 112 and 114 will be properly aligned for mating.

In high speed, high density electrical circuits, the signal quality can degrade if there is too much misalignment in any of the connections between the first and second circuit boards 102 and 104. The guide and power delivery assembly 110 provides guidance that is sufficiently precise to enable the plugs 116 and 120 to be mated with their respective receptacles 118 and 120 without signal degradation.

In addition to providing mechanical guidance between the first and second circuit boards 102 and 104, respectively, the guide and power delivery assembly 110 also delivers power between the first and second circuit boards 102 and 104. In one embodiment, current is delivered from the first circuit board 102 to the second circuit board 104. Alternatively, power delivery may be reversed with the guide pins 130 being mounted on the second circuit board 104 and the guide module 140 being mounted on the first circuit board 102 so that power is delivered from the second circuit board 104 to the first circuit board 102. In combining the guidance and power delivery functions in the guide and power delivery assembly 110, space is saved on the first and second circuit boards 102 and 104.

Figure 3:
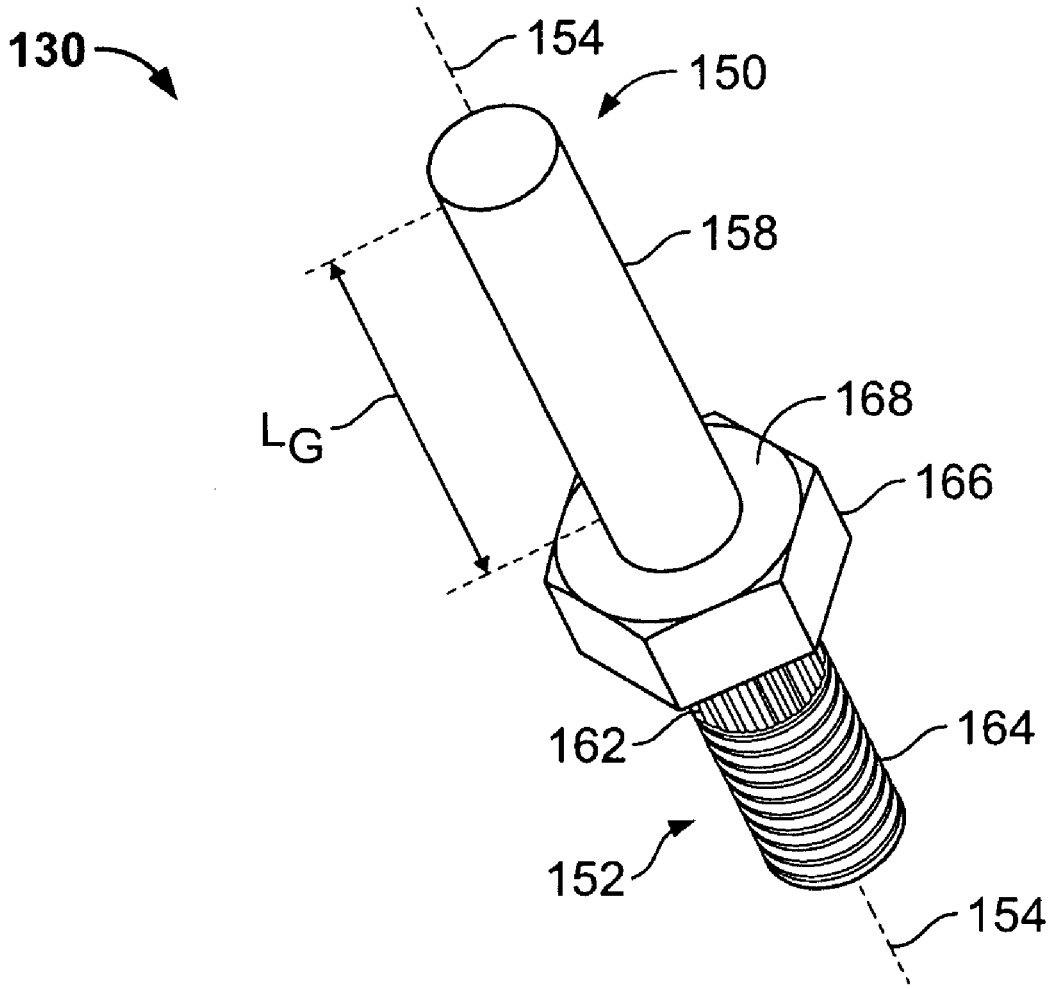
FIG. 3 is a perspective view of a current carrying guide pin formed in accordance with an exemplary embodiment of the present invention.

FIG. 3 illustrates a perspective view of the guide pin 130. The guide pin 130 is a current carrying guide pin that, in an exemplary embodiment, is mounted on the first circuit board 102. The guide pin 130 includes an interface end 150 and an attachment end 152 opposite the interface end 150. A centerline axis 154 extends through the guide pin 130 from the interface end 150 to the attachment end 152. The interface end includes a body 158 formed along the axis 154. The attachment end 152 includes a knurled section 162 and a stud portion 164. In an exemplary embodiment, the stud portion 164 is threaded to receive a nut (not shown) to attach the guide pin 130 to the first circuit board 102. The knurled section 162 engages the interior of a mounting hole (not shown) to center the guide pin 130 in the mounting hole in the circuit board 102. A hex portion 166 separates the interface end 150 and the attachment end 152. The hex portion 166 is provided so that the guide pin 130 can be held securely during attachment to the circuit board 102. A conically shaped section 168 is formed between the body 158 and the hex portion 166.

The guide pins 130 are formed from a conductive material and are mounted in through holes (not shown) in the first circuit board 102 to both mechanically and electrically connect the guide pins 130 to the circuit board 102. The through holes in which the guide pins 130 are mounted are plated through holes. Alternatively, the through holes may not be plated. In such cases, electrical connectivity is established through the bearing surfaces on the top and bottom surfaces of the circuit board 102. The guide pin body 158 has a length $L_G$. In some embodiments, the guide pin bodies 158 of the guide pins 130 have substantially the same in length, such as, for example, when the guide pins 130 are used only for power return. In other embodiments, the guide pin bodies 158 have different lengths to establish a ground or power return connection before the power circuit is connected.

Figure 4:
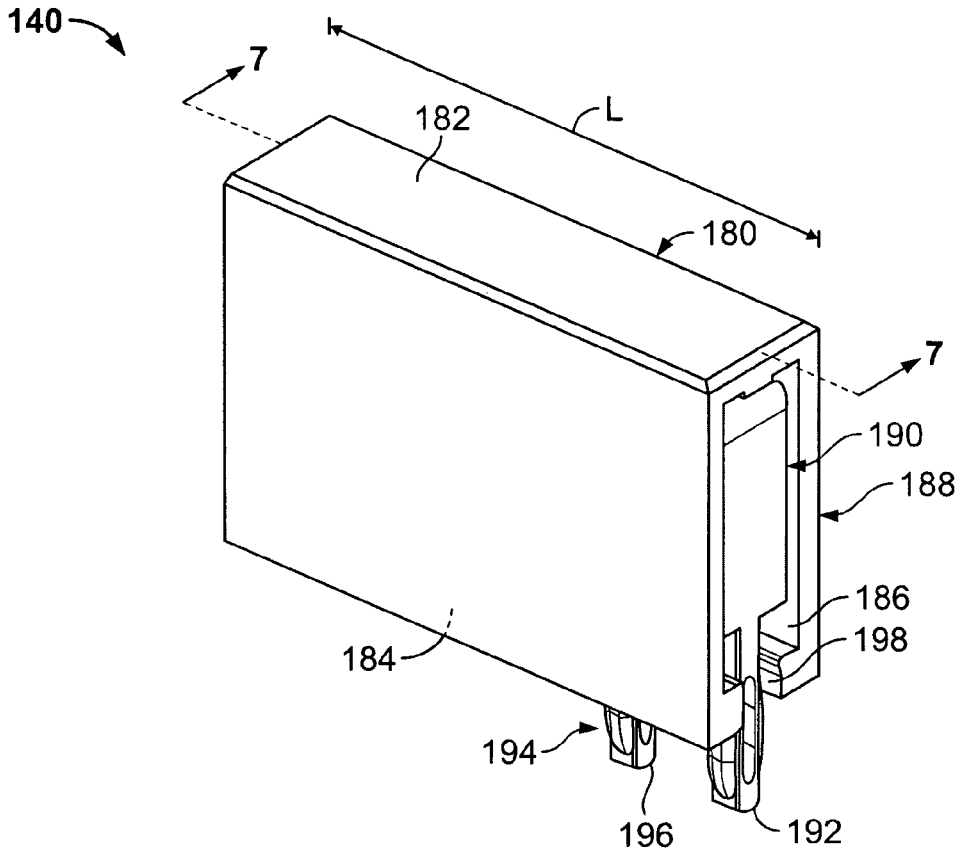
FIG. 4 is a rear perspective view of a guide module formed in accordance with an exemplary embodiment of the present invention.
Figure 5:
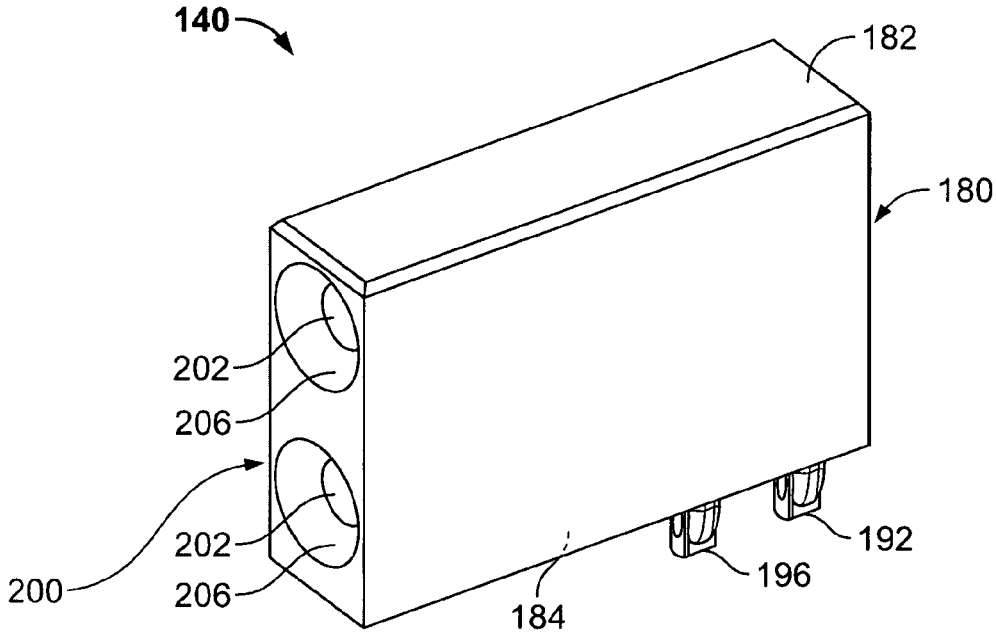
FIG. 5 is a front perspective view of a guide module formed in accordance with an exemplary embodiment of the present invention.

FIG. 4 is a rear perspective view of the guide module 140. FIG. 5 is a front perspective view of the guide module 140. The guide module 140 includes a housing 180 formed from a dielectric material. The housing 180 includes a top wall 182 and a bottom wall 184. The housing 180 includes a contact cavity 186 that opens at a rearward end 188 of the housing 180. The contact cavity 186 holds a first power contact 190 having a contact tail 192, and a second power contact 194 that has a contact tail 196. The contact tails 192 and 196 are linearly spaced along a length L of the housing 180 and extend through a slot 198 formed in the bottom wall 184 of the housing 180. In one embodiment, the contact tails 192 and 196 are configured for press fit installation in the second circuit board 104. In alternative embodiments, the contact tails are configured to be soldered to the circuit board 104.

The guide module 140 includes an interface end 200 that has guide pin receiving holes 202 that receive the guide pin bodies 158 (FIG. 3). A conical recess 206 is formed at the opening of each receiving hole 202. The conical recesses 206 receive the conically shaped section 168 of the guide pins 130 to assist in centering the guide pin 130 in the guide module 140 when the guide pin 130 is received in the guide module 140. A mounting hole 258 (FIG. 7) is provided through the bottom wall 184. The mounting hole receives a threaded fastener to attach the guide module 140 to the second circuit board 104.

Figure 6:
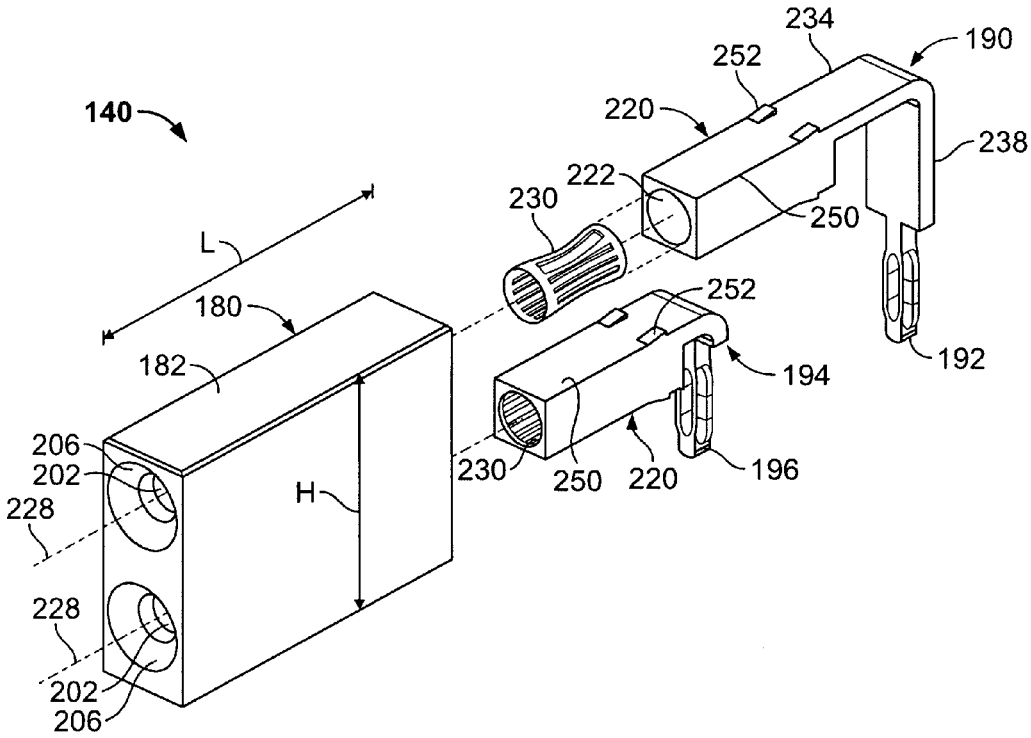
FIG. 6 is an exploded view of the guide module shown in FIGS. 4 and 5.

FIG. 6 is an exploded view of the guide module 140. The power contacts 190 and 194 are received in the housing 180 through the contact cavity 186 (FIG. 4). The power contact 190 is received in the housing 180 proximate a top wall 182 of the housing 180. The power contact 194 is received in the housing 180 proximate a mid wall 254 (FIG. 7) of the housing 180. Each of the power contacts 190 and 194 includes a guide receptacle 220 that includes a guide pin channel 222. In an exemplary embodiment, the guide receptacles 220 have a square shape. However, it is to be understood that the guide receptacles 220 may take other shapes in other embodiments. Each guide pin channel 222 extends along a longitudinal axis 228 that also coincides with a centerline through the receiving holes 202. A band 230 is received in each guide pin channel 222. The bands 230 engage side walls of the guide pin channels 222 and each band also engages a respective guide pin body 158 (FIG. 3) to assist in centering the guide pin body 158 in the guide pin channel 222 and to electrically connect each guide pin 130 with its associated power contact 190, 194. In an exemplary embodiment, the band 230 is a louvered band such as the "Crown Band" sold by Elcon Power Connector Products Division of Tyco Electronics Corporation, or the "Louvertac Band" sold by Tyco Electronics Corporation.

The power contact 190 includes a horizontal extension section 234 to position the contact tail 192 toward the rearward end 188 of the housing 180 so that the linearly spaced orientation of the contact tails 192 and 196 along the length L of the housing 180 is achieved. Similarly, the power contact 190 also includes a vertical extension section 238 to position the guide receptacle 220 of the power contact 190 toward the underside of the top wall 182. The guide receptacles 220 of the power contacts 190 and 194 are thereby linearly spaced vertically along a height H of the housing 180. In the illustrated embodiment, the guide receptacles 220 include an upper surface 250 having wedges 252 formed therein. When the power contacts 190 and 194 are loaded into the housing 180, the wedges 252 engage inner surfaces of the housing 180 to inhibit extraction of the power contacts 190 and 194 from the housing 180. In other embodiments, the wedges 252 may be located on other surfaces of the guide receptacles 220. Further, wedges 252 may be formed on multiple surfaces of the guide receptacles.

Figure 7:
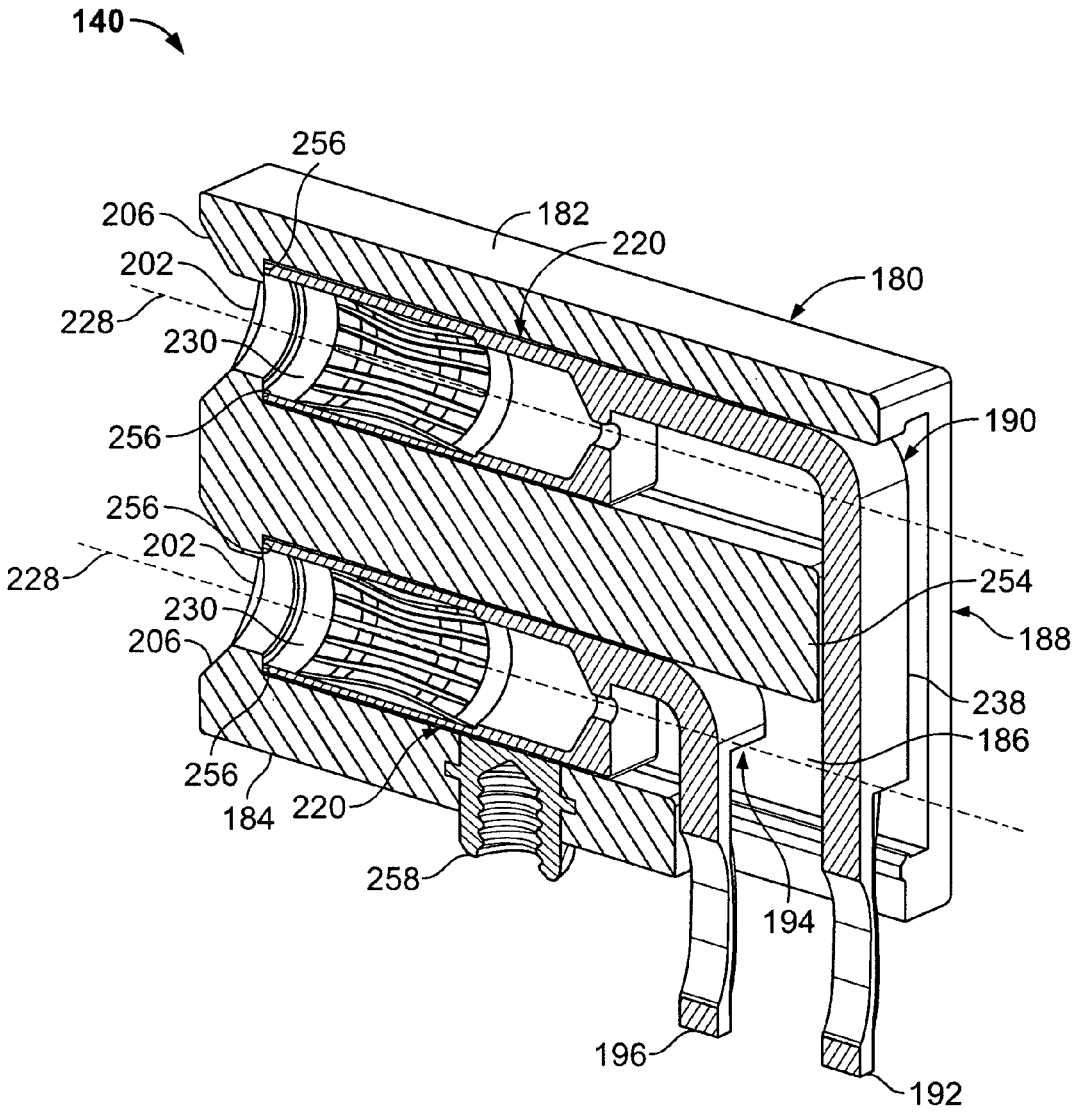
FIG. 7 is a cross sectional view of a guide module taken along the line 7—7 in FIG. 4.

FIG. 7 is a cross sectional view of a guide module 140 taken along the line 7—7 in FIG. 4. As illustrated in FIG. 7, the contacts 190 and 194 are received in the housing 180. A mid wall 254 divides the contact cavity 186 into separate chambers that receive the guide receptacles 220. The top and bottom walls 182 and 184, respectively, as well as the mid wall 254 include lips 256 located proximate the guide pin receiving holes 202 that limit the forward travel of the guide receptacles toward the opening of the guide pin receiving holes 202. The mounting hole 258 receives a threaded fastener to mount the guide module 140 to the circuit board 104 (see FIG. 8). In alternative embodiments, other known contact retention mechanisms may be used.

Figure 8:
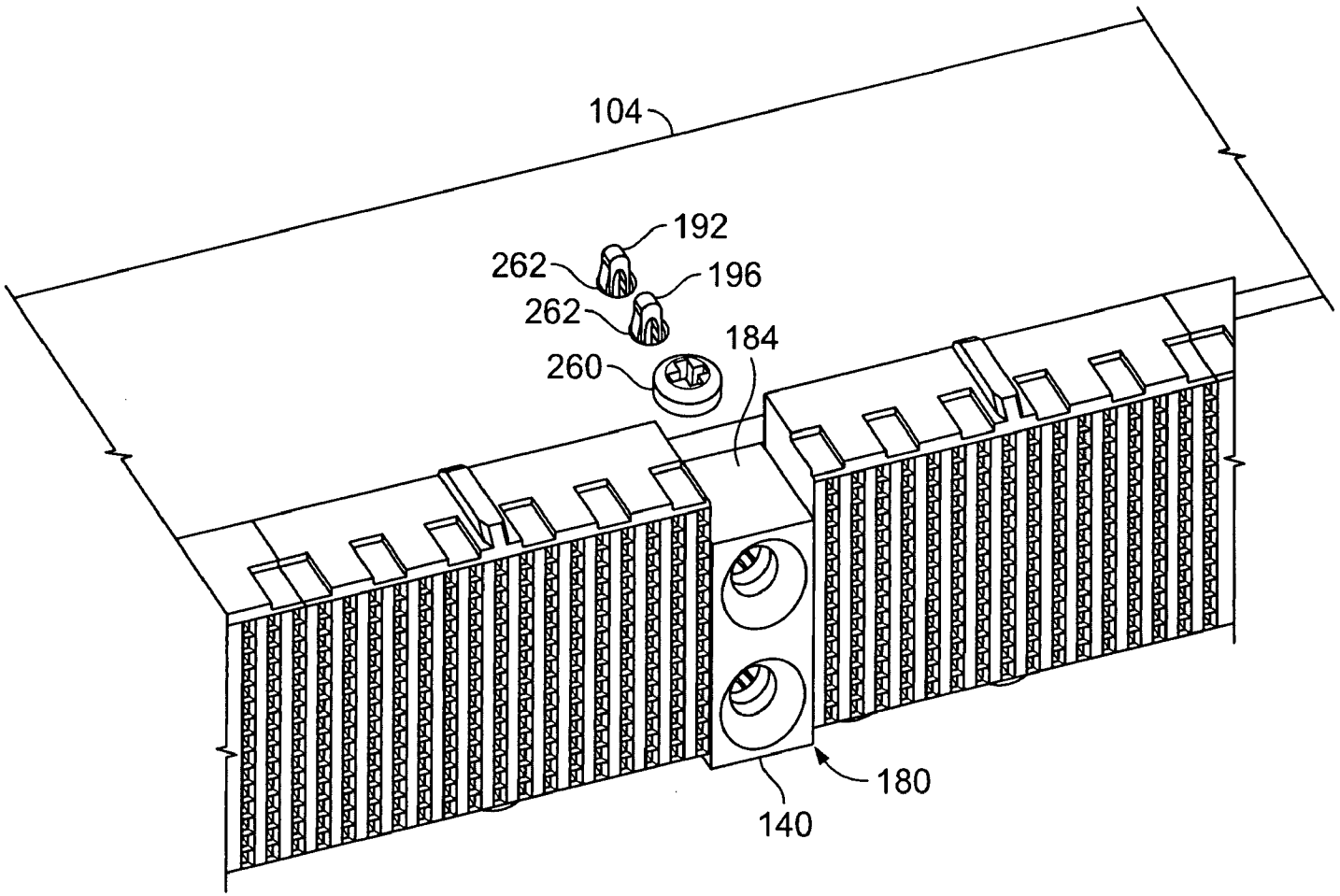
FIG. 8 is a partial perspective of the bottom of a guide module mounted on a circuit board.

FIG. 8 is a partial perspective of the bottom of the guide module 140 mounted on the second circuit board 104. The guide module 140 is attached to the second circuit board 104 with a fastener 260 that is received in a mounting hole 258 (FIG. 7) through the bottom wall 184 of the guide module housing 180. In an exemplary embodiment, the mounting hole is a threaded hole and the fastener is a screw or a bolt. Alternatively, other fastening methods may be employed. The contact tails 192 and 196 are press fit into holes 262 to mechanically and electrically connect the power contacts 190 and 194 to the second circuit board 104. Optionally, the power contacts 190 and 194 may be attached to the second circuit board 104 using other known methods such as soldering.

The embodiments thus described provide a compact guide and power delivery assembly 110 that provides mechanical guidance and also transmits power between first and second circuit boards 102, 104 so that space is saved on the circuit boards. The guide pins 130 are current carrying and are received in guide receptacles 220 that include power contacts 190, 194. The power contacts are arranged in a linearly spaced orientation within the guide module. The mechanical guidance provides the precision required to maintain signal quality in high speed, high density connectors mated at the interface of the first and second circuit boards.

While the invention has been described in terms of various specific embodiments, those skilled in the art will recognize that the invention can be practiced with modification within the spirit and scope of the claims.

What is claimed is:

1. A guide module for connecting a first circuit board and a second circuit board and delivering power between the first and second circuit boards, said guide module comprising:

a guide module housing configured to be mechanically mounted to the first circuit board; and a power contact held in said guide module housing, said power contact configured to convey current between the first and second circuit boards, wherein said power contact includes a guide receptacle configured to receive a guide pin extending from and electrically connected to the second circuit board, said power contact further including a band that is separately provided from and received within said guide receptacle, said band is configured to center said guide pin within said guide receptacle.

2. The guide module of claim 1, further comprising a pair of said power contacts having contact tails positioned in a linearly spaced orientation along a length of said guide module housing.

3. The guide module of claim 1, wherein said guide pin is configured to carry an electrical current.

4. The guide module of claim 1, further comprising a pair of said power contacts including guide receptacles, said guide receptacles being linearly spaced vertically along a height of said guide module housing.

5. The guide module of claim 1, wherein said guide module housing includes a slot formed in a bottom wall thereof, said power contact extending through said slot.

6. The guide module of claim 1, wherein said power contact includes a contact tail and a horizontal extension to position said contact tail of said power contact proximate a rearward end of said guide module housing.

7. The guide module of claim 1, wherein said power contact includes a vertical extension to position said guide receptacle proximate a top wall of said guide module housing.

8. The guide module of claim 1, wherein said power contact includes a guide receptacle having a wedge formed thereon, said wedge engaging an interior surface of said guide module housing to inhibit extraction of said power contact from said guide module housing.

9. A guide module for connecting a first circuit board and a second circuit board and delivering power between the first and second circuit boards, said guide module comprising:

a guide module housing configured to be mechanically mounted to the first circuit board; and a power contact held in said guide module housing, said power contact configured to convey current between the first and second circuit boards, wherein said power contact includes a guide receptacle configured to receive a guide pin, said guide receptacle including a band that is configured to center said guide pin within said guide receptacle, wherein said band is louvered and is configured to electrically connect said guide pin with said power contact.

10. The guide module of claim 1, wherein said guide pin comprises a body comprising a generally cylindrical shape.

* * * * *